US012584488B2

(12) United States Patent
Chalmers et al.

(10) Patent No.: US 12,584,488 B2
(45) Date of Patent: Mar. 24, 2026

(54) BALANCE DRUMS AND SYSTEMS FOR MANAGING AXIAL FORCES FOR PUMPS AND RELATED SYSTEMS AND METHODS

(71) Applicant: DWC & ASSOCIATES, LLC, Lake Havasu City, AZ (US)

(72) Inventors: Dennis W. Chalmers, Lake Havasu City, AZ (US); Mina M. Botrous, Lake Havasu City, AZ (US); Christopher Finley, Lake Havasu City, AZ (US)

(73) Assignee: Flowserve US Company, Irving, TX (US)

( * ) Notice: Subject to any disclaimer, the term of this patent is extended or adjusted under 35 U.S.C. 154(b) by 0 days.

(21) Appl. No.: 18/674,699

(22) Filed: May 24, 2024

(65) Prior Publication Data

US 2025/0361871 A1 Nov. 27, 2025

(51) Int. Cl.

| | |
|---|---|
| ***F04D 23/00*** | (2006.01) |
| ***F04D 29/52*** | (2006.01) |
| ***F04D 29/66*** | (2006.01) |

(52) U.S. Cl.

CPC ..... *F04D 23/001* (2013.01); *F04D 29/528* (2013.01); *F04D 29/661* (2013.01); *F04D 29/66* (2013.01)

(58) Field of Classification Search

CPC .... F04D 23/001; F04D 29/528; F04D 29/661; F04D 29/66

See application file for complete search history.

(56) References Cited

U.S. PATENT DOCUMENTS

| | | | | |
|---|---|---|---|---|
| 3,304,877 | A | 2/1967 | Carter | |
| 3,369,715 | A | 2/1968 | Carter | |
| 3,652,186 | A | 3/1972 | Carter | |
| 3,764,236 | A * | 10/1973 | Carter | F04D 29/049 417/372 |
| 3,918,852 | A * | 11/1975 | Carter | F04D 7/06 417/423.12 |
| 3,975,117 | A | 8/1976 | Carter | |
| RE31,445 | E | 11/1983 | Carter | |

(Continued)

FOREIGN PATENT DOCUMENTS

| | | | |
|---|---|---|---|
| CN | 203730333 U | | 7/2014 |
| CN | 206129637 U | * | 4/2017 |

(Continued)

OTHER PUBLICATIONS

English Translation of Tang et al. (CN 206129637). (Year: 2025).*

(Continued)

*Primary Examiner* — Nathaniel E Wiehe
*Assistant Examiner* — Aye S Htay
(74) *Attorney, Agent, or Firm* — BKRIP LLC

(57) ABSTRACT

A cryogenic pump may include a housing and a drive shaft positioned in the housing. The cryogenic pump may include at least one pump stage positioned in the housing, the at least one pump stage comprising an impeller coupled to the drive shaft. The cryogenic pump may include a balance drum coupled to the drive shaft and positioned in the housing. The cryogenic pump may additionally include a motor comprising a rotor slidably coupled to the drive shaft, the drive shaft configured to rotate with the rotor and move in an axial direction relative to the rotor and the housing during operation of the cryogenic pump.

20 Claims, 5 Drawing Sheets

(56) References Cited

U.S. PATENT DOCUMENTS

| | | | |
|---|---|---|---|
| 4,443,152 | A | 4/1984 | Wong |
| 5,386,708 | A | 2/1995 | Kishorenath |
| 6,167,724 | B1 | 1/2001 | Pozivil |
| 6,255,752 | B1 | 7/2001 | Werner |
| 6,655,930 | B2 | 12/2003 | Sato |
| 6,659,730 | B2 | 12/2003 | Gram |
| 6,902,378 | B2 | 6/2005 | Gaudet |
| 7,063,512 | B2 | 6/2006 | Haesloop |
| 7,207,767 | B2 | 4/2007 | Ashihara |
| 7,455,497 | B2 | 11/2008 | Lee |
| 8,162,596 | B1 | 4/2012 | Kamio |
| 8,240,976 | B1 | 8/2012 | Kamio |
| 8,253,292 | B2 | 8/2012 | Kamio |
| 8,397,506 | B1 | 3/2013 | Wright |
| 8,506,236 | B2 | 8/2013 | Alison-Youel |
| 8,550,771 | B2 | 10/2013 | Kilkenny |
| 8,656,726 | B2 | 2/2014 | Pozivil |
| 8,664,785 | B2 | 3/2014 | Madison |
| 8,823,189 | B2 | 9/2014 | Madison |
| 8,955,339 | B2 | 2/2015 | Kohler |
| 8,963,354 | B2 | 2/2015 | Madison |
| 9,054,568 | B2 | 6/2015 | Kori |
| 9,091,277 | B1 | 7/2015 | Young |
| 9,341,085 | B2 | 5/2016 | Madison |
| 9,461,519 | B2 | 10/2016 | Madison |
| 9,476,314 | B2 | 10/2016 | Besson |
| 9,478,965 | B2 | 10/2016 | Chalmers |
| 9,534,576 | B2 | 1/2017 | Sun |
| 9,546,647 | B2 | 1/2017 | Longsworth |
| 9,562,533 | B2 | 2/2017 | Johchi |
| 9,631,622 | B2 | 4/2017 | Kilkenny |
| 9,759,083 | B2 | 9/2017 | Sgambati |
| 10,030,815 | B2 | 7/2018 | Fuchs |
| 10,175,092 | B2 | 1/2019 | Wahl |
| 10,267,315 | B2 | 4/2019 | Chalmers |
| 10,816,140 | B2 | 10/2020 | De Nardis |
| 10,914,516 | B2 | 2/2021 | Ragot |
| 10,954,952 | B2 | 3/2021 | Boeglin |
| 2008/0122226 | A1 | 5/2008 | Madison |
| 2009/0004032 | A1 | 1/2009 | Kaupert |
| 2009/0031754 | A1 | 2/2009 | Ushitora |
| 2013/0216405 | A1* | 8/2013 | Johchi ..... F04D 13/0653 417/373 |
| 2013/0221784 | A1* | 8/2013 | Kori ..... F04D 13/06 310/90 |
| 2013/0283824 | A1 | 10/2013 | Madison |
| 2015/0044027 | A1 | 2/2015 | Van Dam |
| 2015/0143822 | A1* | 5/2015 | Chalmers ..... F04D 13/06 417/424.2 |
| 2016/0090864 | A1 | 3/2016 | Finley |
| 2016/0216010 | A1 | 7/2016 | Longsworth |
| 2017/0097008 | A1 | 4/2017 | Doll |
| 2019/0293067 | A1 | 9/2019 | Bonvilain |
| 2020/0149434 | A1 | 5/2020 | Spadacini |

FOREIGN PATENT DOCUMENTS

| | | | |
|---|---|---|---|
| CN | 111852893 | | 10/2020 |
| CN | 116123102 | | 5/2023 |
| EP | 2250454 | A2 | 11/2010 |
| EP | 3026269 | A1 | 6/2016 |
| EP | 3739210 | A1 | 11/2020 |
| GB | 2337795 | | 12/1999 |
| JP | 2005139964 | A | 6/2005 |
| JP | 2009191730 | A | 8/2009 |
| JP | 2011047301 | A | 3/2011 |
| KR | 100641569 | | 11/2006 |
| KR | 101064574 | | 9/2011 |
| WO | WO2005057016 | | 6/2005 |
| WO | 2024243566 | A1 | 11/2024 |

OTHER PUBLICATIONS

The LNG Process Chain, downloaded May 5, 2021, 8 pages.
Ebara International Corporation Cryodynamics Division, downloaded May 5, 2021, 20 pages.
Written Opinion for PCT/US2025/030246, Aug. 22, 2025, 7 pages.
ISR for PCT/US2025/030246, Aug. 22, 2025, 3 pages.

* cited by examiner

BALANCE DRUMS AND SYSTEMS FOR MANAGING AXIAL FORCES FOR PUMPS AND RELATED SYSTEMS AND METHODS

TECHNICAL FIELD

The present disclosure relates generally to pumps and components of such pumps, such as cryogenic pumps including submerged motor cryogenic pumps. More particularly, embodiments of the present disclosure may relate to balance drums and systems for managing axial forces for submerged motor cryogenic pumps that may be positioned in tank columns and used in the liquefaction, transportation, and regasification of refrigerated methane liquid, liquefied natural gas, related light hydrocarbon liquids, and/or other cryogenic fluids such as liquid hydrogen and/or liquid ammonia, and related systems and methods.

BACKGROUND

Pumps may be utilized to control the flow of fluids in various hydraulic processes. For example, some pumps may be used to increase (e.g., boost) the pressure in a hydraulic system, while other pumps may be used to move the fluids from one location to another.

Such devices may be implemented in cryogenic applications including, for example, the liquefaction, transportation and regasification of refrigerated methane liquid, liquefied natural gas (LNG), and/or related light hydrocarbon liquids, and/or other cryogenic fluids such as liquid hydrogen and/or liquid ammonia. For example, cryogenic submerged pumps may be used in the LNG supply industry where pumps are used to transfer the product from storage tanks to LNG carriers at the production plant, from the carriers to shoreside storage tanks, and then pumped at high pressure through vaporizers to pipelines.

Certain conditions, such as startup conditions, may cause significant thrust forces to be temporarily applied to a drive shaft of a cryogenic pump. For example, at startup the inertia of cryogenic fluid surrounding an inducer of the cryogenic pump may cause significant axial thrust forces to act on an inducer as the rotation of the inducer accelerates from a stopped condition to a full speed condition. Since the inducer is coupled to the drive shaft, the axial thrust forces on the inducer may be transferred to the drive shaft and any of the other components that are coupled to the drive shaft, such as pump impellers, bearings, a rotor of a motor, etc. The axial thrust may cause components attached to the drive shaft to impact other components of the pump and/or may cause significant axial thrust to act on the bearings of the pump. As a result, significant damage may be caused to components of the pump and the bearings of the pump may fail as a result of the axial loading. This may result in debris shedding from the bearings and/or other components that may cause a catastrophic chain reaction resulting in pump failure.

In view of the foregoing, it would be desirable to improve pumps, components of pumps, and methods of operating pumps. For example, it would be desirable to improve pumps, components of pumps, and methods of operating pumps to accommodate axial thrust that may be applied to pump drive shafts during various operating phases and operating conditions.

BRIEF SUMMARY

In some aspects, the techniques described herein relate to a cryogenic pump, including: a housing; a drive shaft positioned in the housing; at least one pump stage positioned in the housing, the at least one pump stage including an impeller coupled to the drive shaft; a balance drum coupled to the drive shaft and positioned in the housing; and a motor including a rotor slidably coupled to the drive shaft, the drive shaft configured to rotate with the rotor and move in an axial direction relative to the rotor and the housing during operation of the cryogenic pump.

In some aspects, the techniques described herein relate to a cryogenic pump, wherein the balance drum includes a serrated axial end surface, the balance drum being positioned in the cryogenic pump and configured to define an axial space between the serrated axial end surface and an adjacent surface of the cryogenic pump when the cryogenic pump is in steady-state operation, and the axial space is configured to enable the balance drum to move in an axial direction to reduce a space between the serrated axial end surface and the adjacent surface of the cryogenic pump.

In some aspects, the techniques described herein relate to a cryogenic pump, wherein the axial space is sized and configured to be occupied by fluid during operation of the cryogenic pump, the axial space further configured to enable the fluid to be compressed in response to an axial force applied to the balance drum in order to provide cushioning to prevent or reduce mechanical impact between components of the cryogenic pump.

In some aspects, the techniques described herein relate to a cryogenic pump, wherein the balance drum further includes a serrated radially outer surface.

In some aspects, the techniques described herein relate to a cryogenic pump, wherein the rotor includes a rotor shaft having an aperture extending axially therethrough and the drive shaft is positioned within and extending through the aperture of the rotor shaft.

In some aspects, the techniques described herein relate to a cryogenic pump, further including a bearing coupled to a first end of a rotor shaft and positioned within a bushing, the bushing having an axial length greater than an axial length of the bearing to allow the bearing to move in an axial direction relative to the bushing during operation of the cryogenic pump.

In some aspects, the techniques described herein relate to a cryogenic pump, further including two angular contact bearings oriented in opposite directions and coupled to a second end of a rotor shaft.

In some aspects, the techniques described herein relate to a cryogenic pump, further including an arcuate serrated side surface configured to define one or more fluid flow channels between the arcuate serrated side surface of the balance drum and a radially adjacent portion of the cryogenic pump.

In some aspects, the techniques described herein relate to a balance drum for a cryogenic pump, the balance drum including: a central aperture sized to be coupled to a drive shaft of a cryogenic pump; an arcuate serrated side surface configured to define one or more fluid flow channels between the arcuate serrated side surface of the balance drum and a radially adjacent portion of the cryogenic pump; and a serrated axial end surface configured to define one or more additional fluid flow channels between the serrated axial end surface of the balance drum and an axially adjacent portion of the cryogenic pump.

In some aspects, the techniques described herein relate to a balance drum, further including at least one channel extending into the balance drum at a location adjacent to the serrated axial end surface, wherein the at least one channel has been formed into the balance drum by removing at least a portion of the serrated axial end surface in order to customize the balance drum for use in any one of a plurality of selected cryogenic pump configurations.

In some aspects, the techniques described herein relate to a balance drum, wherein the at least one channel includes a first outer channel positioned between a first radial side of the serrated axial end surface and the arcuate serrated side surface and a second inner channel positioned between a second radial side of the serrated axial end surface and the central aperture.

In some aspects, the techniques described herein relate to a balance drum, further including a flange surrounding a portion of the central aperture, wherein a radially inner surface of the flange is configured to be in contact with a radially outer surface of a rotor shaft of a motor of the cryogenic pump.

In some aspects, the techniques described herein relate to a balance drum, further including at least one channel extending into the balance drum at a location between the flange and the serrated axial end surface.

In some aspects, the techniques described herein relate to a method of operating a cryogenic pump, the method including: rotating a drive shaft of the cryogenic pump having a plurality of impellers fixedly coupled to the drive shaft with a rotor of a motor; applying an axial force to the drive shaft; and sliding the drive shaft in an axial direction relative to the rotor of the motor while rotating the drive shaft with the rotor of the motor in response to the axial force.

In some aspects, the techniques described herein relate to a method, further including moving a balance drum coupled to the drive shaft in an axial direction relative to the rotor.

In some aspects, the techniques described herein relate to a method, further including compressing a fluid with the balance drum in response to axial movement of the balance drum.

In some aspects, the techniques described herein relate to a method, further including slowing the axial movement of the balance drum and drive shaft with the fluid compressed by the balance drum.

In some aspects, the techniques described herein relate to a method, further including sliding a bearing attached to the rotor in an axial direction relative to a housing of the cryogenic pump.

In some aspects, the techniques described herein relate to a method, further including sliding the bearing within a bushing in an axial direction relative to the bushing.

In some aspects, the techniques described herein relate to a method, further including applying an axial force to a set of two angular contact bearings with at least one of a balance drum or the rotor.

In some aspects, the techniques described herein relate to a method of customizing a balance drum for a cryogenic pump, the method including: providing a balance drum having a serrated axial end surface; determining a desired pressure difference across the balance drum during operation of the cryogenic pump; and removing a portion of the serrated axial end surface to provide a balance drum designed to achieve the desired pressure difference across the balance drum during operation of the cryogenic pump.

In some aspects, the techniques described herein relate to a method of manufacturing a cryogenic pump, the method including coupling an impeller of at least one pump stage to the drive shaft; coupling a balance drum to the drive shaft; and slidably coupling a rotor of a motor to the drive shaft such that the drive shaft will rotate with the rotor and the drive shaft may move in an axial direction relative to the rotor during operation of the cryogenic pump.

In some aspects, the techniques described herein relate to a method, further including positioning the balance drum in the cryogenic pump such that an axial space is provided when the pump is in steady-state operation, and the axial space allows the balance drum to move in an axial direction relative to the rotor during operation of the cryogenic pump to bring a serrated upper surface of the balance drum closer to an adjacent overlying surface of the cryogenic pump.

In some aspects, the techniques described herein relate to a method, wherein slidably coupling the rotor of the motor to the drive shaft includes slidably coupling the rotor to the drive shaft with a splined coupling.

In some aspects, the techniques described herein relate to a method, further including positioning a portion of the drive shaft within an aperture extending axially through a rotor shaft of the rotor.

In some aspects, the techniques described herein relate to a method, further including: coupling a bearing to a first end of the rotor shaft; and positioning the bearing within a bushing, the bushing having an axial length greater than an axial length of the bearing to allow the bearing to move in an axial direction relative to the bushing during operation of the cryogenic pump.

In some aspects, the techniques described herein relate to a customizable balance drum for a cryogenic pump, the customizable balance drum including central aperture sized to be coupled to a drive shaft of a cryogenic pump; an arcuate serrated side surface; a serrated upper surface sized to have portions removed for customizing the customizable balance drum for use in any one of a plurality of specific cryogenic pump configurations.

BRIEF DESCRIPTION OF THE DRAWINGS

While the specification concludes with claims particularly pointing out and distinctly claiming what are regarded as embodiments of the present disclosure, various features and advantages of embodiments of the disclosure may be more readily ascertained from the following description of example embodiments of the disclosure when read in conjunction with the accompanying drawings, in which:

DETAILED DESCRIPTION

The illustrations presented herein are not meant to be actual views of any particular pump or component thereof, but are merely idealized representations employed to describe illustrative embodiments. The drawings are not necessarily to scale. Elements common between figures may retain the same numerical designation.

As used herein, relational terms, such as "first," "second," "upper," "bottom," etc., are generally used for clarity and convenience in understanding the disclosure and accompanying drawings and do not connote or depend on any specific preference, orientation, or order, except where the context clearly indicates otherwise.

As used herein, the term "and/or" means and includes any and all combinations of one or more of the associated listed items.

As used herein, the terms "vertical" and "lateral" refer to the orientations as depicted in the figures.

As used herein, the term "substantially" or "about" in reference to a given parameter means and includes to a degree that one skilled in the art would understand that the given parameter, property, or condition is met with a small degree of variance, such as within acceptable manufacturing tolerances. For example, a parameter that is substantially met may be at least 90% met, at least 95% met, at least 99% met, or even 100% met.

As used herein, the term "fluid" may mean and include fluids of any type and composition. Fluids may take a liquid form, a gaseous form, or combinations thereof, and, in some instances, may include some solid material. In some embodiments, fluids may convert between a liquid form and a gaseous form during a cooling or heating process as described herein. In some embodiments, the term fluid includes gases, liquids, and/or pumpable mixtures of liquids and solids.

While embodiments of the disclosure may discuss LNG and/or related light hydrocarbon liquids, embodiments of the disclosure may also be used with other fluids, such as, for example, liquid hydrogen or liquid ammonia.

Figure 1:
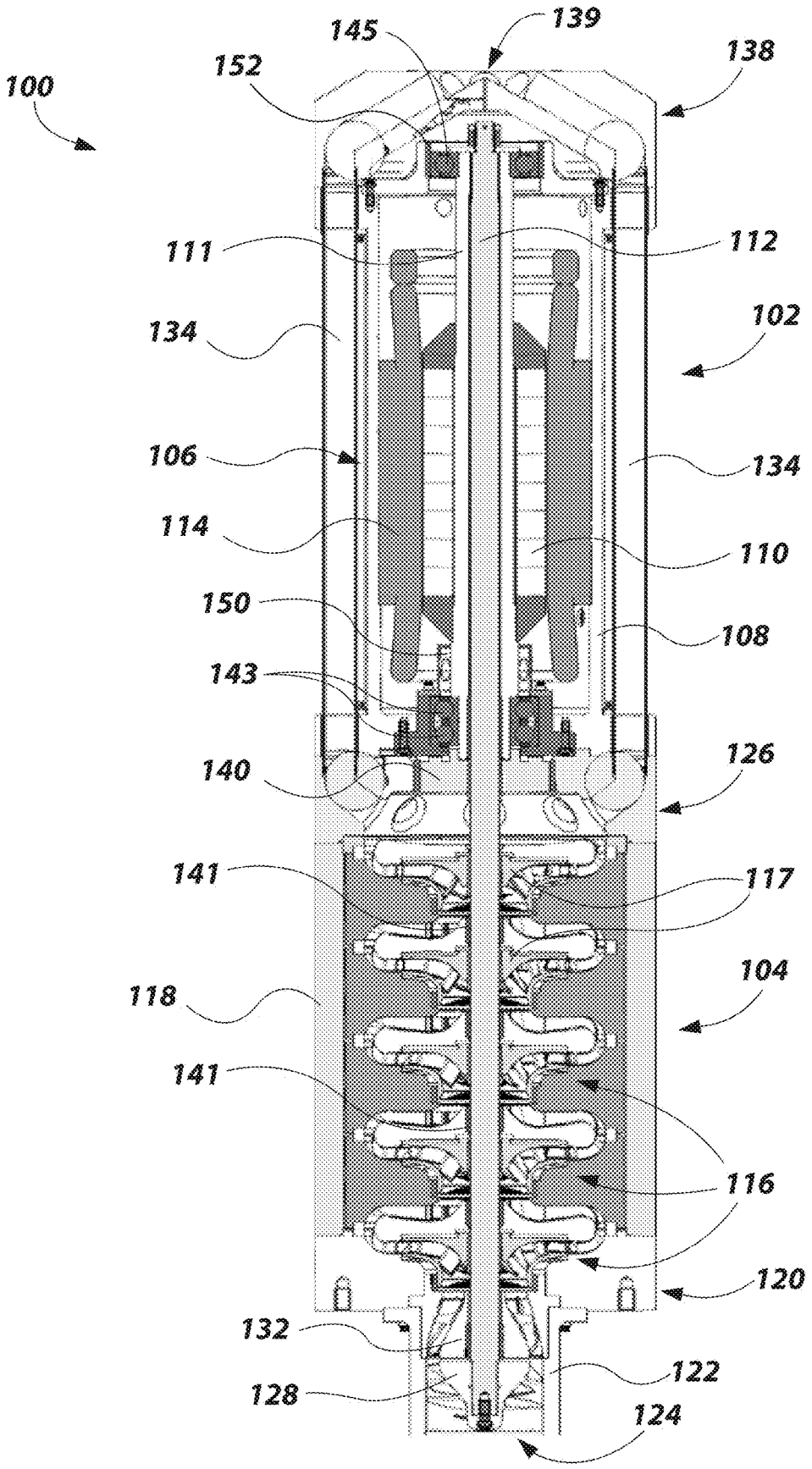
FIG. 1 is an elevational cross-sectional view of a modular submerged motor cryogenic pump, according to an embodiment of the present disclosure.

FIG. 1 is an elevational cross-sectional view of a modular submerged motor cryogenic pump 100, according to an embodiment of the present disclosure, comprising a motor module 102 and a hydraulic module 104. As the modular submerged motor cryogenic pump 100 may be operated in cryogenic conditions, the modular submerged motor cryogenic pump 100 may be provided with all of the components being suitable for operation within a working temperature range between about 75 K and about 200 K. Additionally, the modular submerged motor cryogenic pump 100 may be designed to provide leak-proof containment at working pressures between about 1 bar absolute pressure (barA) and about 160 barA.

The motor module 102 may include a motor 106 located within a motor housing 108. The motor 106 may include a rotor 110 (e.g., a permanent magnet rotor) and a stator 114 surrounding the rotor 110. In some embodiments the motor 106 may be a variable speed synchronous motor. In further embodiments, the motor may be configured to rotate relatively fast relative to convention motors, for example, the motor may be configured to rotate at about 2,000 rotations per minute (RPM) through 10,000 RPM, above 4,000 RPM, above 5,000 RPM, above 6,000 RPM, and/or above 7,000 RPM.

The hydraulic module 104 may include one or more pump stage 116 (e.g., five pump stages 116 as shown) located within a pump housing 118, and each pump stage may comprise a pump, such as a centrifugal pump. The pump housing 118 may include an end plate 120 having a nozzle 122 defining a fluid inlet 124 to the modular submerged motor cryogenic pump 100 at a first end and a hydraulic manifold 126 at a second end. An inducer 128 may be located within the nozzle 122 between the fluid inlet 124 and a pump stage 116.

Additionally, an inducer guide vane 132 may be located between the inducer 128 and the pump stage 116, which may be utilized to recover velocity energy in the fluid exiting the inducer to further increase fluid pressure (i.e., head) at the inlet to the pump stage 116.

The motor module 102 may be coupled to the hydraulic module 104 and fluid channels (e.g., pipes 134) may be positioned to direct fluid form the hydraulic manifold 126 of the hydraulic module 104 to a hydraulic manifold 138 located at an upper end of the motor module 102. The hydraulic manifold 138 may include a fluid outlet 139 for directing fluid out of the modular submerged motor cryogenic pump 100.

A drive shaft 112 may extend along a central portion of the modular submerged motor cryogenic pump 100 extending from the motor module 102 and through the hydraulic module 104 to the inducer 128. A first end of the drive shaft 112 may be located above the motor 106 near to the hydraulic manifold 138 and an opposing second end of the drive shaft 112 may be located in the nozzle 122 and coupled to the inducer 128. Additionally, the pump stages 116, the motor 106, and a balance drum 140 may be coupled to the drive shaft 112.

The inducer 128 may be rigidly coupled to the drive shaft 112 via one or more of an interference fit (e.g., a friction fit or a close bore fit), interlocking splines, a keyed coupling (e.g., a key, a keyseat, and a keyway), a collet, and/or a fastener (e.g., a nut, a bolt, and/or a retaining ring) to facilitate the rotation of the inducer 128 via the drive shaft 112. Accordingly, the inducer 128 may be rigidly fixed to the drive shaft 112 such the inducer 128 will move with the drive shaft 112 and may not move independently of the drive shaft 112 (e.g., the inducer 128 will rotate with, but will not rotate independently of, the drive shaft 112 and the inducer 128 will move axially with, but will not move in an axial direction independently of, the drive shaft 112).

An impeller 117 of each pump stage 116 may be rigidly coupled to the drive shaft 112 via one or more of an interference fit (e.g., a friction fit or a close bore fit), interlocking splines, a keyed coupling (e.g., a key, a keyseat, and a keyway), a collet, and/or a fastener (e.g., a nut, a bolt, and/or a retaining ring) to facilitate the rotation of the impellers 117 via the drive shaft 112. Accordingly, the impellers 117 may be rigidly fixed to the drive shaft 112 such that impellers 117 will move with the drive shaft 112 and may not move independently of the drive shaft 112 (e.g., the impellers 117 will rotate with, but will not rotate independently of, the drive shaft 112 and the impellers 117 will move axially with, but will not move in an axial direction independently of, the drive shaft 112).

The balance drum 140 may be rigidly coupled to the drive shaft 112 via one or more of an interference fit (e.g., a friction fit or a close bore fit), interlocking splines, a keyed coupling (e.g., a key, a keyseat, and a keyway), a collet, and/or a fastener (e.g., a nut, a bolt, and/or a retaining ring) to facilitate the rotation of the balance drum 140 via the drive shaft 112 and to facilitate the transfer of axial forces between the balance drum 140 and the drive shaft 112. Accordingly, the balance drum 140 may be rigidly fixed to the drive shaft 112 such that the balance drum 140 will move with the drive shaft 112 and may not move independently of the drive shaft 112 (e.g., the balance drum 140 will rotate with, but will not rotate independently of, the drive shaft 112 and the balance drum 140 will move axially with, but will not move in an axial direction independently of, the drive shaft 112).

The rotor 110 of the motor 106, however, may be slidably coupled to the drive shaft 112 such that the drive shaft 112 will rotate with the rotor 110, but the drive shaft 112 may move in an axial direction relative to the rotor 110 during operation of the modular submerged motor cryogenic pump 100. Accordingly, the motor 106 may be utilized to power the rotation of the drive shaft 112 through the slidable connection with the rotor 110, but the drive shaft 112 may slide and move in and axial direction (e.g., a direction parallel to the axis of rotation of the drive shaft 112) relative to the rotor 110 so that the drive shaft 112 may move axially independently of the rotor 110. In some embodiments, the rotor 110 may be coupled to the drive shaft 112 with a splined coupling wherein the splines extend parallel to (e.g., along) the axis of rotation of the drive shaft 112 to facilitate the transfer or torque between the rotor 110 and the drive shaft 112 while allowing the drive shaft 112 to slide and move in an axial direction relative to the rotor 110.

The rotor 110 may include a rotor shaft 111 having an aperture extending axially therethrough and the drive shaft 112 may be positioned within and extending through the aperture of the rotor shaft 111. The aperture of the rotor shaft 111 of the rotor 110 may be sized to both allow passage of the drive shaft 112 therethrough and allow the drive shaft 112 to slide axially within the aperture. Accordingly, the drive shaft 112 may be coupled to the rotor 110 at the top of the rotor, near to the hydraulic manifold 138.

The rotor 110 and the drive shaft 112 may be coupled to various bushings (e.g., brass bushings and/or bronze bushings) and/or bearings (e.g., ball bearings and/or roller bearings) within the modular submerged motor cryogenic pump 100 to facilitate the rotation of the drive shaft 112 and the rotor 110 while maintaining the lateral positioning of the drive shaft 112 and the rotor 110. For example, the drive shaft 112 may extend through multiple bushings 141 located in the hydraulic module 104, and the rotor 110 may be coupled to two angular contact bearings 143 at a bottom end of the rotor 110 and coupled to a bearing 145 at a top end of the rotor 110.

The two angular contact bearings 143 may be angular contact ball bearings that may be positioned in opposing directions (e.g., the two angular contact bearings 143 may be oriented front-to-front or back-to-back). By orienting the two angular contact bearings 143 in opposite directions, the two angular contact bearings 143 may accommodate significant axial forces in both directions (e.g., upward axial thrust and downward axial thrust). The outer races of the two angular contact bearings 143 may be coupled with the motor housing 108 and fixed relative to the motor housing 108 and the inner races of the two angular contact bearings 143 may be coupled with the rotor 110, such as by a press fit. A debris catcher 150 may be located above the two angular contact bearings 143, between the two angular contact bearings 143 and an interior cavity of the motor housing 108, which may allow the passage of fluid into the interior cavity of the motor housing 108 while at least partially preventing or reducing the incursion of debris (e.g., pieces breaking loose from a bearing) into the interior cavity of the motor housing 108.

The bearing 145 may be a radial ball bearing with an inner race coupled to the top end of the rotor 110, such as with a press fit and/or with a washer that may be secured with a nut and/or bolt that may be coupled to an end of the drive shaft 112. An outer race of the bearing 145 may be positioned within a bushing 152 having an axial length that is greater than an axial length of the bearing 145 to allow the bearing 145 to move in an axial direction relative to the bushing 152 during operation of the modular submerged motor cryogenic pump 100. The outer race of the bearing 145 may be coupled to the bushing 152 with a friction fit to prevent or reduce rotational movement of the outer race of the bearing 145 relative to the bushing 152, but the friction fit may be sized to still allow axial movement of the bearing 145 relative to the bushing 152 in the event of a significant axial thrust acting on the bearing 145. The bushing 152 may be fixed relative to the motor housing 108, such as by a press fit into a hub connected to the motor housing 108.

The balance drum 140 may be rigidly coupled to the drive shaft 112 at a location between the motor 106 and the pump stages 116 at or near the top of the hydraulic manifold 126. A bottom surface of the balance drum 140 may be exposed to a cavity within the hydraulic manifold 126. The balance drum 140 may be configured to balance axial forces acting on the drive shaft 112 during the operation of the modular submerged motor cryogenic pump 100.

Axial forces may be applied to the drive shaft during the operation by gravity applying a downward force on the drive shaft 112 and the components coupled to the drive shaft 112. Axial forces may additionally be applied to the drive shaft 112 by hydraulic forces acting on the impellers 117 and the inducer 128. To balance the axial forces acting on the drive shaft 112 the balance drum 140 may utilize the difference in pressure forces acting on the bottom surfaces of the balance drum 140 and the top surfaces of the balance drum 140, as fluid pressure acting on a surface may apply a force in a direction normal (e.g., perpendicular) to the surface. The upper surfaces of the balance drum 140 may be modified to affect what proportion of the upper surfaces are exposed to various pressures acting on the upper surfaces creating downward axial force, this downward axial force acting on the upper surfaces is combined with the axial forces acting upward on the bottom surfaces of the balance drum 140 to achieve the desired total axial force acting on the balance drum to balance the axial forces acting on the drive shaft 112 during steady state operation, as will be discussed in further detail herein with reference to FIGS. 2-4.

In some embodiments, the balance drum 140 may also be configured to meter the flow of fluid into the motor module 102 during the operation of the modular submerged motor cryogenic pump 100. Accordingly, a portion of the pumped fluid from the hydraulic module 104 may be directed past the balance drum 140 and into the motor module 102 to, for example, regulate the temperature of components therein during operation, such as the motor 106 and bearings.

Figure 2:
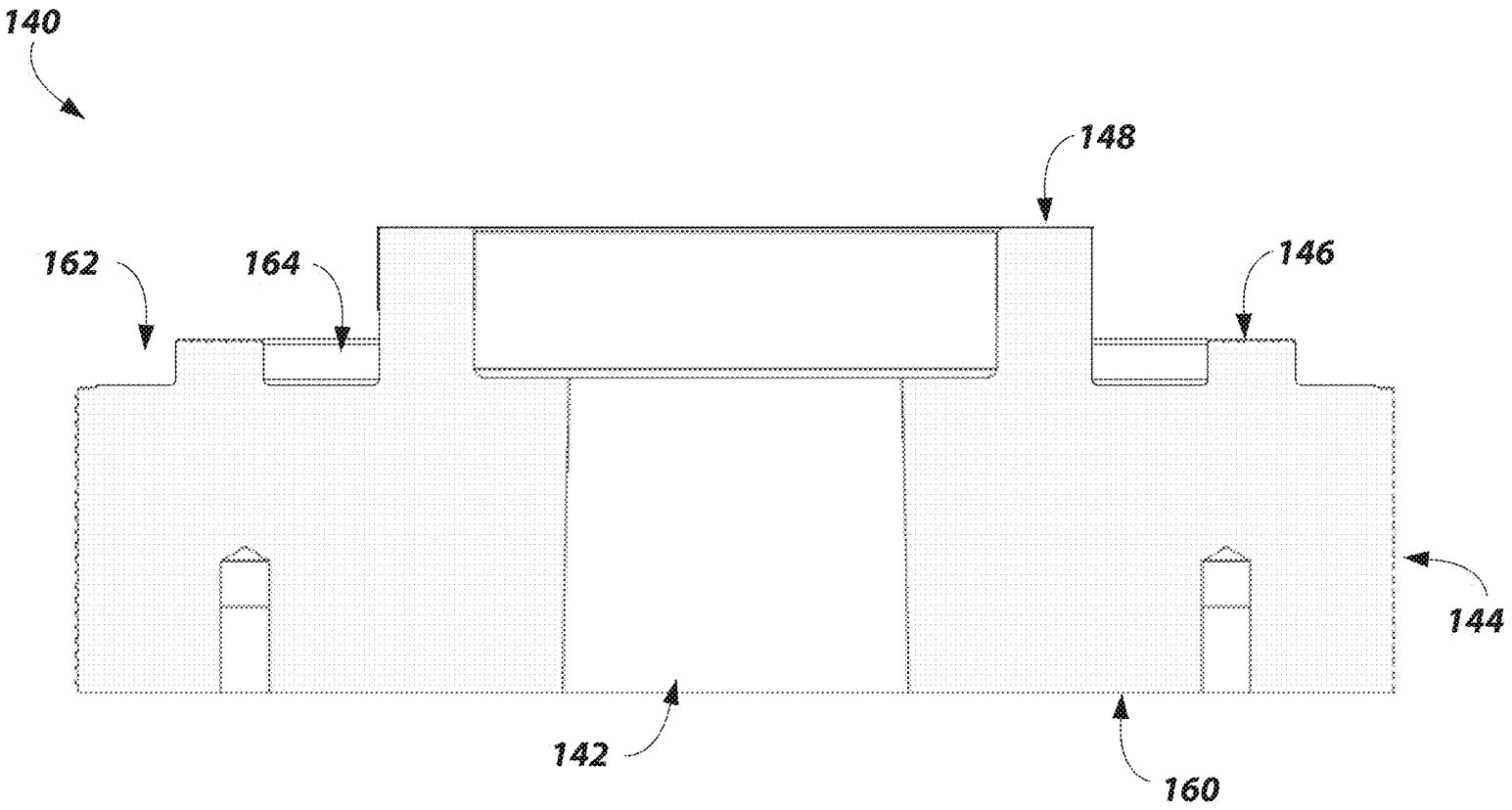
FIG. 2 shows a cross-sectional view of a balance drum that may be utilized in the modular submerged motor cryogenic pump of FIG. 1.

FIG. 2 shows a cross-sectional view of a balance drum 140 that may be utilized in a pump, for example, the modular submerged motor cryogenic pump 100 according to an embodiment of the present disclosure. As discussed below, the balance drum 140 may be customizable based on the intended application of the pump. The balance drum 140 may be generally disk shaped with a central aperture 142 configured for coupling the balance drum to the drive shaft 112, the central aperture 142 having a central axis that is coaxial with the axis of rotation of the drive shaft 112 and the balance drum 140 when installed in the modular submerged motor cryogenic pump 100. A lower surface 160 may be substantially planar, and at least a portion of an arcuate side surface of the balance drum 140 may include serrations (e.g., ridges and/or grooves) formed therein to define a serrated side surface 144 as shown and discussed below with relation to FIG. 3. In some embodiments, at least a portion of an upper surface of the balance drum 140 (e.g., an axial end surface) may include serrations formed therein to define a serrated upper surface 146 as also shown and discussed below with relation to FIG. 3.

A flange 148 may extend from the upper surface of the balance drum 140 between the serrated portion of the upper surface and the central aperture 142. A first channel 162 (e.g., a radially outer channel) may be located between the serrated side surface 144 and the serrated upper surface 146, and a second channel 164 (e.g., a radially inner channel) may be located between the serrated upper surface 146 and the central aperture 142 (e.g., between the serrated upper surface and the flange 148).

Figure 3:
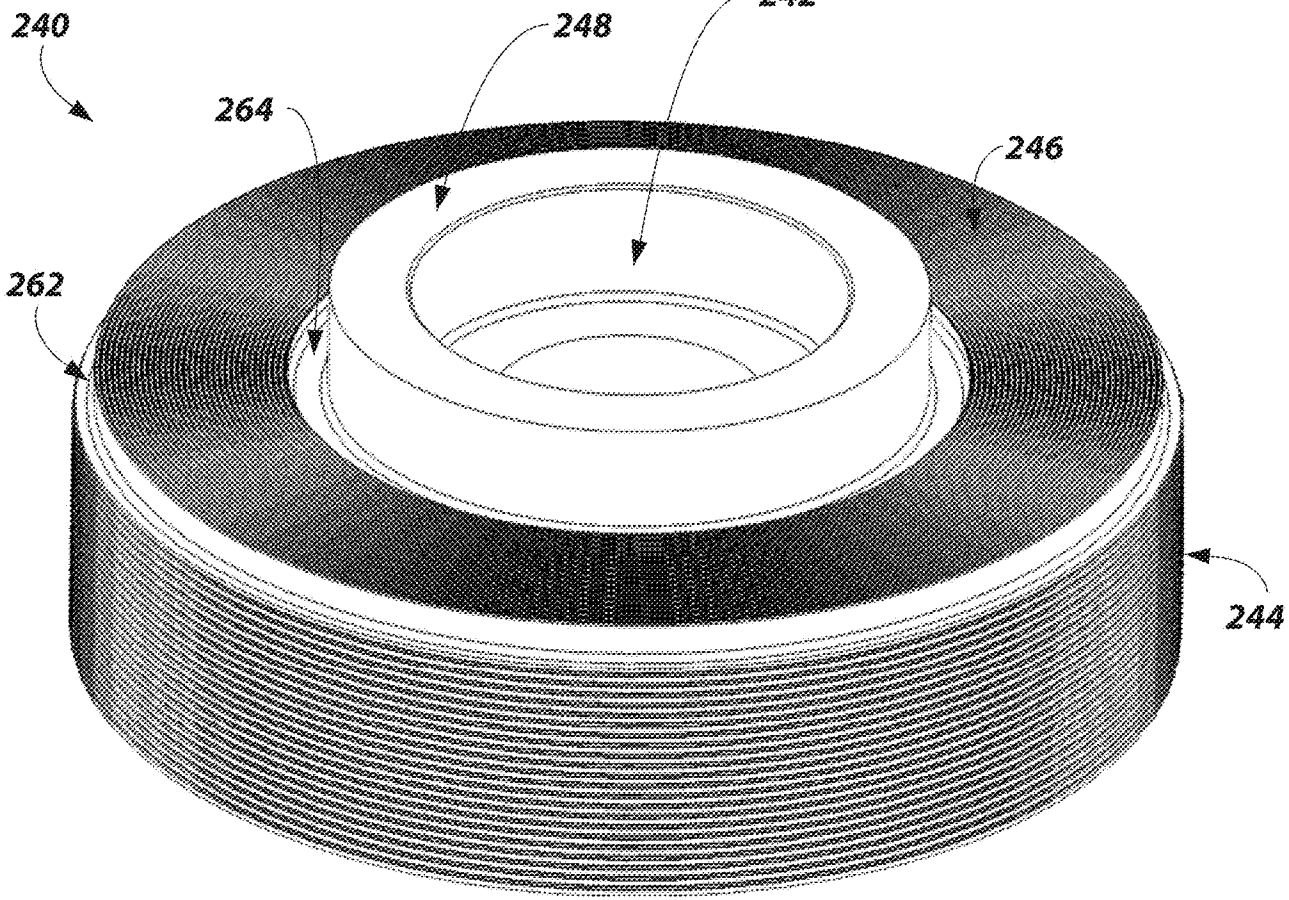
FIG. 3 shows an isometric view of a customizable balance drum that may be customized to be used as the balance drum of FIG. 2.

FIG. 3 shows an isometric view of a customizable balance drum 240 that may be customized to be used in a pump, such as, for example, as the balance drum 140 for the modular submerged motor cryogenic pump 100 according to an embodiment of the present disclosure. Like the balance drum 140, the customizable balance drum 240 may be generally disk shaped with a central aperture 242 configured for coupling the balance drum 240 to a drive shaft. A bottom surface (e.g., lower surface 260 (FIG. 4)) may be substantially planar, and at least a portion of an arcuate side surface of the customizable balance drum 240 may include serrations formed therein to define a serrated side surface 244. Additionally, at least a portion of an upper surface of the customizable balance drum 240 may include serrations formed therein to define a serrated upper surface 246, which may be oversized relative to a serrated upper surface of a balance drum that is configured to be utilized in a pump to allow for the customization of the customizable balance drum 240 for a specific cryogenic pump.

A flange 248 may extend from the upper surface of the customizable balance drum 240 between the serrated upper surface 246 and the central aperture 242. A first channel 262 may be located between the serrated side surface 244 and the serrated upper surface 246, and a second channel 264 may be located between the serrated upper surface 246 and the central aperture 242 (e.g., between the serrated upper surface 246 and the flange 248), and the first channel 262 and the second channel 264 may be undersized to allow for the customization of the customizable balance drum 240 for a specific cryogenic pump. Optionally, the customizable balance drum 240 may not include the first channel 262 and/or the second channel 264. For example, the customizable balance drum 240 may be similar to that shown in FIG. 4 before removal of material to define the first channel 262 and the second channel 264. In some embodiments, the customizable balance drum 240 may still include the first channel 262 that is defined as a notch between the serrated upper surface 246 and the serrated side surface 244.

In some embodiments, the customizable balance drum 240 may be machined from a solid billet of material, such as bronze, brass, steel, or aluminum, such as with a computer numerical control (CNC) mill and/or lathe.

Figure 4:
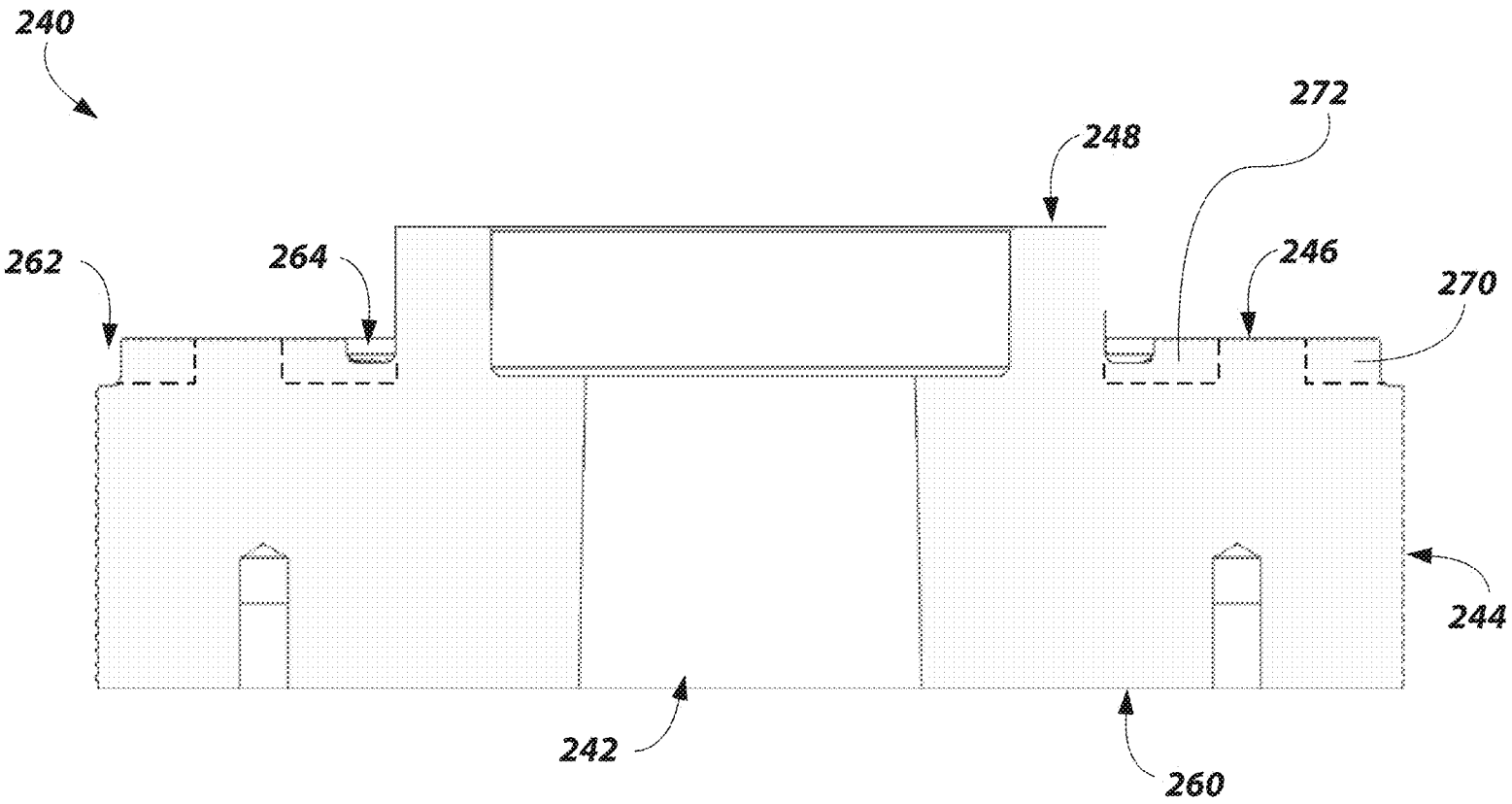
FIG. 4 shows a cross-sectional view of the customizable balance drum of FIG. 3.

FIG. 4 shows a cross-sectional view of the customizable balance drum 240. After a size and location of the first channel 262, the second channel 264, and the serrated upper surface 246 are determined to accommodate a specific cryogenic pump configuration, the first channel 262 may be enlarged (or formed) by machining (e.g., by turning on a lathe and/or milling on a mill) away a portion 270 (as indicated with a dashed line) of the serrated upper surface 246 to form an appropriately sized first channel 262 and the second channel 264 may be enlarged (or formed) by machining away another portion 272 (as indicated with a dashed line) of the serrated upper surface 246 to form an appropriately sized second channel 264 and an appropriately sized and located serrated upper surface 246 to form a balance drum for a specific cryogenic pump (e.g., the balance drum 140 for the modular submerged motor cryogenic pump 100).

In operation, the serrated side surface 244 and the serrated upper surface 246 may act to create a pressure gradient across the serrated side surface 244 and the serrated upper surface 246. Due to the pressure gradients, the pressure below the serrated side surface 244 may be at substantially the full pump operating pressure, the pressure in the first channel 262 may be less than the full pump operating pressure, and the pressure in the second channel 264 may be less than the pressure in the first channel 262. Accordingly, changing the size of the serrated upper surface 246 may change the pressure gradient resulting across the serrated upper surface 246, therefore changing the difference in pressures between the first channel 262 and the second channel 264. Changing the size of the serrated upper surface 246 may additionally affect the amount of fluid that flows into the motor housing. Additionally, changing the location of the serrated upper surface 246 may change the relative sizes of the first channel 262 and the second channel 264. As the pressure in the first channel 262 is greater than the pressure in the second channel 264, decreasing the size of the first channel 262 relative to the second channel 264 may decrease the axial forces acting on the upper surfaces due to the pressures acting on the surfaces at the bottom of the first channel 262 and the second channel 264. Similarly, increasing the size of the first channel 262 relative to the second channel 264 may increase the axial forces acting on the upper surfaces due to the pressures acting on the surfaces at the bottom of the first channel 262 and the second channel 264. Accordingly, the location of the serrated upper surface 246 may be selected to achieve a desired total axial force applied (e.g., the difference between the upward axial force acting on the bottom and the downward axial force acting on the top).

Referring again to FIG. 1, the modular submerged motor cryogenic pump 100 may be manufactured by coupling an appropriately sized motor module 102 to an appropriately sized hydraulic module 104.

For the hydraulic module 104, the inducer 128 may be coupled to an end of the drive shaft 112. Additionally, an inducer guide vane 132 may be positioned between the inducer 128 and the first pump stage 116 with the drive shaft 112 extending through a central aperture of the inducer guide vane 132. The inducer guide vane 132 may be positioned in the end plate 120 and the nozzle 122 may be coupled to the end plate 120. The impellers 117 of the pump stages 116 may be coupled to the drive shaft 112, and the drive shaft 112 may be positioned to extend through the multiple bushings 141 in the pump stages 116 in a stage-by-stage basis as the pump stages 116 are stacked to form the hydraulic module 104. The pump housing 118 may be positioned about the pump stages 116, the balance drum 140 may be coupled to the drive shaft 112, and the hydraulic manifold 126 may be positioned at or near the top end of the hydraulic module 104, surrounding the balance drum 140. Accordingly, the balance drum 140 may be positioned such that an axial space is provided between the balance drum 140 and overlying structures of the modular submerged motor cryogenic pump 100 (e.g., a portion of the angular contact bearings 143, a portion of the pump housing, etc.) when the pump is in steady-state operation, which may allow the balance drum 140 to move in an axial direction relative to the rotor 110 during operation of the modular submerged motor cryogenic pump 100.

For the motor module 102, a stack of permanent magnets may be coupled to the rotor shaft 111 of the motor 106 to form the rotor 110, and the stator 114 may be positioned within the motor housing 108. An assembly comprising the two angular contact bearings 143 and the debris catcher 150 may be coupled to the bottom end of the motor housing 108 and the motor housing 108 may be coupled to the hydraulic manifold 126 of the hydraulic module 104.

The rotor may be positioned over the drive shaft 112 such that the drive shaft 112 may be positioned to extend through the rotor 110 of the motor 106. The rotor 110 may be slidably coupled to the drive shaft 112, such as with a splined coupling. Additionally, the bottom end of the rotor 110 may be positioned within and coupled to the inner races of the two angular contact bearings 143. A top plate with the bushing 152 may be coupled to the motor housing 108, and the bearing 145 may be coupled to the top end of the rotor 110 and positioned within the bushing 152, and a nut and/or bolt may be coupled to the end of the drive shaft 112.

Finally, the bottom ends of the pipes 134 may be coupled to the hydraulic manifold 126 and the hydraulic manifold 138 may be coupled to the top of the motor module 102 and coupled to the top ends of the pipes 134.

The modular submerged motor cryogenic pump 100 may be customizable and configurable to provide a cryogenic pump that meets specific pumping requirements. For example, if a pump is desired with more pumping capacity than the modular submerged motor cryogenic pump 100 shown, one or more additional pump stage 116 may be added to the hydraulic module 104 and/or the motor 106 may be modified to provide additional torque by adding additional permanent magnets to a stack of permanent magnets on the rotor 110 and/or by increasing the size of the stator 114. Similarly, if a pump is desired with less pumping capacity than the modular submerged motor cryogenic pump 100 shown, one or more fewer pump stage 116 may be included in the hydraulic module 104 and/or the motor 106 may be modified to provide less torque by providing fewer permanent magnets to the stack of permanent magnets on the rotor 110 and/or by decreasing the size of the stator 114.

In view of the foregoing, multiple substantially identical customizable balance drums 240 may be manufactured and kept in inventory that may later be customized for use in one of any of a variety of modular submerged motor cryogenic pump configurations when needed. Additionally, multiple components, such as pump stages 116, motor housings 108, and hydraulic manifolds 126, 138, may be utilized for multiple modular submerged motor cryogenic pump configurations. For each specific modular submerged motor cryogenic pump configuration, the size and location of the first channel 262, the second channel 264, and the serrated upper surface 246 may be determined to accommodate the specific cryogenic pump and the customizable balance drum 240 may be machined relatively quickly and easily to provide a balance drum specific for a modular submerged motor cryogenic pump configuration.

Various features of the modular submerged motor cryogenic pump 100 described herein may be utilized in operation of the modular submerged motor cryogenic pump 100 to manage axial forces, such as spikes of axial thrust that may occur during startup, that may act on the drive shaft 112 and the various components coupled to the drive shaft 112. One such feature is the design and arrangement of the balance drum 140 utilized in the modular submerged motor cryogenic pump 100.

In operation, the modular submerged motor cryogenic pump 100 may be located in a cryogenic fluid tank, vessel, and/or container (not shown) and submerged in cryogenic fluid with the fluid inlet 124 located proximate to the bottom of the cryogenic fluid tank, vessel, and/or container. Electrical power may be provided to the motor 106 which may cause the stator 114 to rotate, which may cause the drive shaft 112 coupled to the stator 114 to rotate. The drive shaft 112 may rotate the impellers 117 of the pump stages 116 and the inducer 128 to initiate pumping of the cryogenic fluid by the modular submerged motor cryogenic pump 100.

If the motor 106 is provided significant electric power on startup (e.g., if the motor 106 is connected directly to line power) the rotation of the stator 114 may accelerate relatively quickly, thus causing the pump stages 116 and the inducer 128 to accelerate relatively quickly. The quick acceleration of the inducer 128 and impellers 117, and the inertia of the fluid, may impart significant axial forces on the inducer 128 and/or impellers 117, which may be transferred to the drive shaft 112. The fluid located in the axial space above the balance drum 140 may become compressed in such an instance and provide cushioning to the axial forces acting on the drive shaft 112.

In some embodiments, the motor 106 may be a variable speed synchronous motor driven with a variable frequency drive. Accordingly, the rotational acceleration of the motor 106 may be controlled and slowed at startup which may reduce the magnitude of spikes in the axial thrust acting on the drive shaft 112 during startup of the modular submerged motor cryogenic pump 100.

The rotation of the inducer 128 may draw fluid into the modular submerged motor cryogenic pump 100 and may compress and accelerate the fluid and direct the fluid into the inducer guide vane 132 to provide the fluid to the first pump stage 116. The pump stages 116 may pump the fluid therethrough increasing the pressure and/or velocity of the fluid in each pump stage 116. The fluid may then be directed into the hydraulic manifold 126, through the pipes 134, into the hydraulic manifold 138, and out of the modular submerged motor cryogenic pump 100 via the fluid outlet 139. A portion of the fluid may flow into the motor module 102 via the balance drum 140 and cool components such as the motor 106 and bearings 143, 145. In addition to metering a portion of the fluid flow into the motor module 102, the balance drum 140 may operate to balance axial forces acting on the drive shaft 112.

Figure 5:
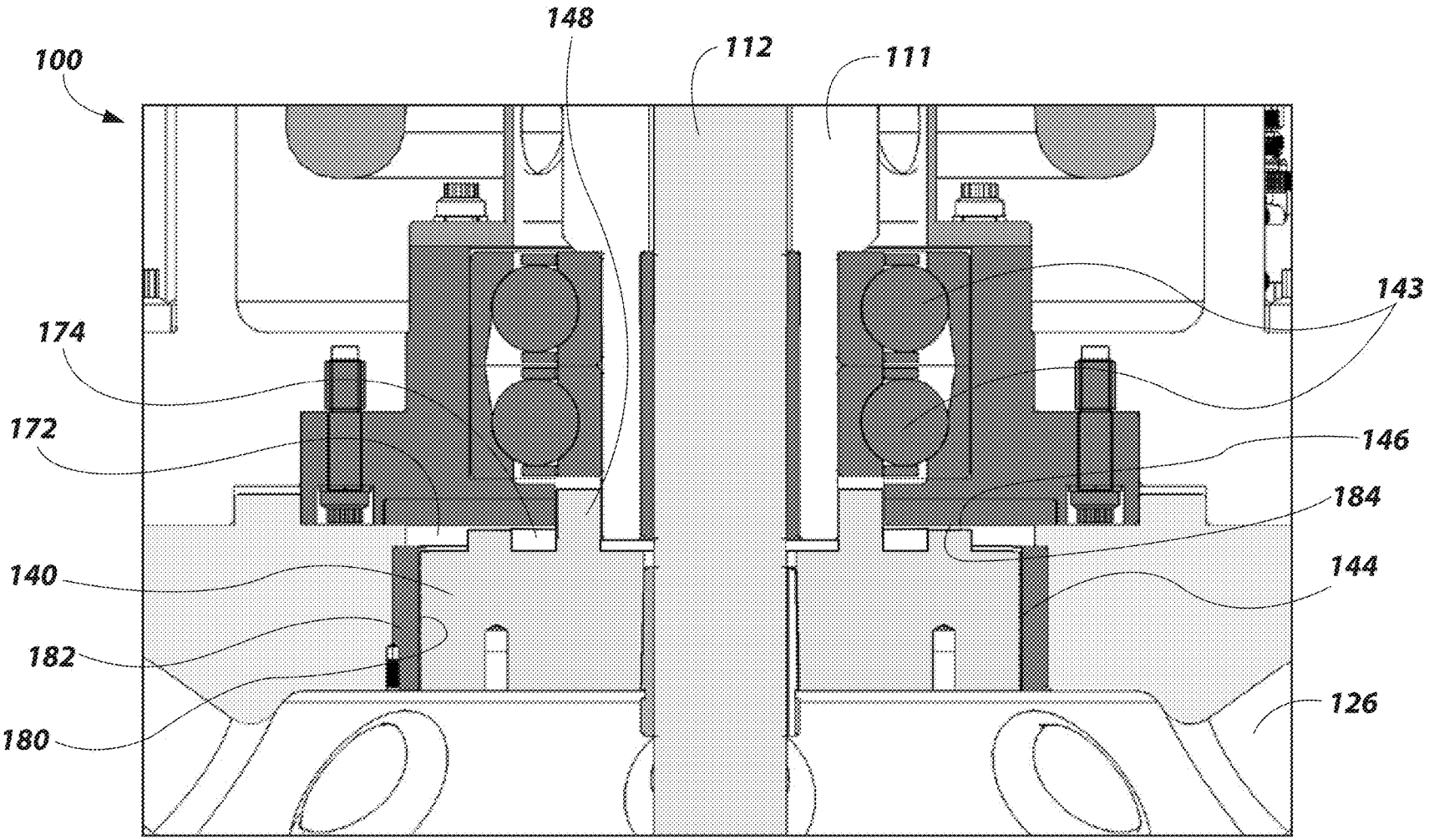
FIG. 5 shows a cross-sectional detail view of the balance drum within the modular submerged motor cryogenic pump of FIG. 1.

FIG. 5 shows a cross-sectional detailed view of the balance drum 140 within the modular submerged motor cryogenic pump 100. In normal steady-state operation, the axial forces acting on the balance drum 140 may balance the axial forces acting on the drive shaft 112 and the various components coupled to the drive shaft 112, such as the impellers 117 of the pump stages 116 and the inducer 128 (see FIG. 1). As the impellers 117 and inducer 128 rotate to move fluid through the modular submerged motor cryogenic pump 100 the fluid dynamic forces may apply an axial force which may be transmitted to the drive shaft 112. Additionally, gravity acting on the drive shaft 112 and the components coupled thereto may apply an axial force on the drive shaft 112. The balance drum 140 may be designed to counteract these axial forces acting on the drive shaft 112. The fluid pressure acting on a bottom side of the balance drum 140 may be higher than the fluid pressure acting on a top side of the balance drum 140. Accordingly, the fluid pressure acting on the balance drum 140 may apply an axial force to the balance drum 140 that may substantially balance the other forces acting on the balance drum 140 and drive shaft 112 during steady-state operation of the modular submerged motor cryogenic pump 100.

As previously discussed, axial forces may be applied to the drive shaft during the operation by gravity applying a downward force on the drive shaft 112 and the components coupled to the drive shaft 112. Axial forces may additionally be applied to the drive shaft 112 by hydraulic forces acting on the impellers 117 and the inducer 128. To balance the axial forces acting on the drive shaft 112 the balance drum 140 may utilize the upward forces created by the differences in pressures acting on the bottom and the top of the balance drum 140.

The serrated side surface 144 and the serrated upper surface 146 may be spaced from adjacent surfaces within the modular submerged motor cryogenic pump 100 such that the flow of fluid passing over the serrated side surface 144 and the serrated upper surface 146 may be regulated. Moreover, the configuration of the serrations of the serrated side surface 144 and the serrated upper surface 146 may act to regulate the flow of fluid (a serrated surface may slow the flow of fluid over the surface when compared to a smooth surface). Accordingly, during operation, there may be a pressure differential across each of the serrated side surface 144 and the serrated upper surface 146.

Accordingly, the size of the serrated upper surface 146 may affect the pressure gradient across the serrated upper surface 146 and may affect the amount of fluid that flows into the motor housing 108. Additionally, as the pressure in the first channel 162 is greater than the pressure in the second channel 164, the size of the first channel 162 relative to the second channel 164 may affect the axial forces acting on the upper surfaces due to the pressures acting on the surfaces at the bottom of the first channel 162 and the second channel 164.

The balance drum 140 may be located within a cavity at or near the top of the hydraulic manifold 126 with the serrated side surface 144 of the balance drum 140 located adjacent to an arcuate surface 180 of the hydraulic manifold 126 having a generally cylindrical shape. Optionally, the hydraulic manifold 126 may include a bushing 182 and the arcuate surface 180 may be an inner surface of the bushing 182. The serrated upper surface 146 may be located proximate to an overlying surface 184 that may be substantially planar and be generally annular or disc shaped.

Optionally, a radially inner surface and/or a radially outer surface of the flange 148 may be in contact with an adjacent structure, but the upper axially facing surface of the flange may be spaced from any other structures in the modular submerged motor cryogenic pump 100. For example, a radially inner surface of the flange 148 may be in contact with a radially outer surface of the rotor shaft 111 and/or a radially outer surface of the flange 148 may be in contact with a surface of the hydraulic manifold 126, but the contact may still allow the flange 148 to slide axially against the radially adjacent surface.

The pressure acting on the bottom surface of the balance drum 140 may be substantially the full pressure produced by the hydraulic module 104 (see FIG. 1). The pressure may be reduced over the serrated side surface 144 and a pressure within a first cavity 172, defined in part by the first channel 162 and located between the serrated side surface 144 and the serrated upper surface 146, may be less than the pressure within the hydraulic manifold 126 acting on the lower surface 160 of the balance drum 140. Similarly, the pressure may be further reduced over the serrated upper surface 146 and a pressure within a second cavity 174, defined in part by the second channel 164 and located between the serrated upper surface 146 and the flange 148, may be less than the pressure within the first cavity 172.

Accordingly, the size and location of the serrated upper surface 146 may affect the pressures within the first cavity 172 and the second cavity 174 and may be utilized to customize the balance drum 140 to balance the axial forces acting on the balance drum 140 for a specific modular submerged motor cryogenic pump configuration. Ideally, during steady-state operation of the modular submerged motor cryogenic pump 100, the axial forces acting on the balance drum 140 may be sufficiently balanced such that the balance drum 140 does not contact any other component of the modular submerged motor cryogenic pump 100 other than the drive shaft 112. For example, the balance drum 140 may be configured such that a layer of fluid may separate the balance drum 140 from adjacent components of the modular submerged motor cryogenic pump 100 with the exception of the drive shaft 112.

In addition to balancing axial forces acting on the drive shaft 112 during steady-state operating conditions, the balance drum 140 and drive shaft 112 may be configured and arranged to accommodate spikes in axial forces, such as may occur during startup of the modular submerged motor cryogenic pump 100. As previously discussed herein, the drive shaft 112 may be slidably coupled to the rotor 110 of the motor 106 such that the drive shaft 112 may slide and move in an axial direction relative to the rotor 110 (see FIG. 1). Rather than being in contact with the two angular contact bearings 143 and/or the rotor 110, the upper surfaces of the balance drum 140 may be spaced from any structures that are not configured to move axially with the drive shaft 112, and an axial space may be provided axially above the balance drum 140. The balance drum 140 may be configured so that the serrated upper surface 146 is closer to any adjacent axially overlying structure than any other portion of the balance drum 140 and a layer of fluid may axially overlie the upper surfaces of the balance drum 140 (e.g., within the first channel 162 and the second channel 164 and overlying the serrated upper surface 146 and flange 148.

In the event of a significant upward axial thrust, such as during startup of the modular submerged motor cryogenic pump 100, the fluid overlying the upper surfaces of the balance drum 140 may become compressed and apply a fluid pressure on the upper surfaces of the balance drum 140 counteracting the upward axial thrust and creating a cushioning effect that may slow and/or stop the axial movement of the balance drum 140 and prevent and/or reduce the mechanical impact of adjacent components of the modular submerged motor cryogenic pump 100 that may otherwise occur. Furthermore, the cushioning from the compression of the fluid overlying the balance drum 140 may at least partially prevent or reduce axial loading that may be applied to the two angular contact bearings 143, the rotor shaft 111, and/or the bearing 145 (FIG. 1), which may otherwise occur if the balance drum 140 was in direct contact with the two angular contact bearings 143 and/or the rotor shaft 111, and may at least partially prevent damage to the two angular contact bearings 143, or other components, that may otherwise occur.

Referring to FIGS. 1 and 5, in the event that axial forces are applied to the two angular contact bearings 143 due to an axial thrust event, the configuration of the two angular contact bearings 143 may enable the two angular contact bearings 143 to withstand a significant axial load without significant damage and/or failure occurring (when compared to other bearing configurations, such as radial bearings), thus creating a system backup for unexpected and/or extreme axial thrust events. Additionally, should any significant axial forces be applied to the bearing 145, the bearing 145 may slide and move axially within the bushing 152, which may prevent or reduce any damage that may otherwise occur as a result of the axial loading on the bearing 145. In view of the foregoing, even in the event of a relatively large and unexpected axial force acting on the drive shaft 112, the bearings 143, 145 may continue to operate without significant damage and/or failure.

While the present disclosure has been described herein with respect to certain illustrated embodiments, those of ordinary skill in the art will recognize and appreciate that it is not so limited. Rather, many additions, deletions, and modifications to the illustrated embodiments may be made without departing from the scope of the disclosure as hereinafter claimed, including legal equivalents thereof. In addition, features from one embodiment may be combined with features of another embodiment while still being encompassed within the scope of the disclosure as contemplated by the inventors.

What is claimed is:

1. A cryogenic pump, comprising:

a housing;

a drive shaft positioned in the housing;

at least one pump stage positioned in the housing, the at least one pump stage comprising an impeller coupled to the drive shaft;

a balance drum coupled to the drive shaft and positioned in the housing; and a motor comprising a rotor slidably coupled to the drive shaft, the drive shaft configured to rotate with the rotor and move in an axial direction relative to the rotor and the housing during operation of the cryogenic pump, such that the drive shaft is enabled to move axially independently of the rotor.

2. The cryogenic pump of claim 1, wherein the balance drum comprises a serrated axial end surface, the balance drum being positioned in the cryogenic pump and configured to define an axial space between the serrated axial end surface and an adjacent surface of the cryogenic pump when the cryogenic pump is in steady-state operation, and the axial space is configured to enable the balance drum to move in an axial direction to reduce a space between the serrated axial end surface and the adjacent surface of the cryogenic pump.

3. The cryogenic pump of claim 2, wherein the axial space is sized and configured to be occupied by fluid during operation of the cryogenic pump, the axial space further configured to enable the fluid to be compressed in response to an axial force applied to the balance drum in order to provide cushioning to prevent or reduce mechanical impact between components of the cryogenic pump.

4. The cryogenic pump of claim 2, wherein the balance drum further comprises a serrated radially outer surface.

5. The cryogenic pump of claim 1, wherein the rotor comprises a rotor shaft having an aperture extending axially therethrough and the drive shaft is positioned within and extending through the aperture of the rotor shaft.

6. The cryogenic pump of claim 1, further comprising a bearing coupled to a first end of a rotor shaft and positioned within a bushing, the bushing having an axial length greater than an axial length of the bearing to allow the bearing to move in an axial direction relative to the bushing during operation of the cryogenic pump.

7. The cryogenic pump of claim 6, further comprising two angular contact bearings oriented in opposite directions and coupled to a second end of the rotor shaft.

8. The cryogenic pump of claim 1, further comprising an arcuate serrated side surface configured to define one or more fluid flow channels between the arcuate serrated side surface of the balance drum and a radially adjacent portion of the cryogenic pump.

9. A cryogenic pump, comprising:

a motor having a rotor; and a balance drum comprising:

a central aperture sized to be coupled to a drive shaft of the cryogenic pump such that the drive shaft with the balance drum coupled thereto is configured to independently move axially relative to the rotor of the motor that rotates the drive shaft;

an arcuate serrated side surface configured to define one or more fluid flow channels between the arcuate serrated side surface of the balance drum and a radially adjacent portion of the cryogenic pump;

a serrated axial end surface configured to define a plurality of additional fluid flow channels between the serrated axial end surface of the balance drum and an axially adjacent portion of the cryogenic pump;

a first outer channel positioned between a first radial side of the serrated axial end surface and the arcuate serrated side surface; and a second inner channel positioned between a second radial side of the serrated axial end surface and the central aperture.

10. The cryogenic pump of claim 9, wherein at least one of the first outer channel or the second inner channel has been formed into the balance drum by removing at least a portion of the serrated axial end surface in order to customize the balance drum for use in any one of a plurality of selected cryogenic pump configurations.

11. The cryogenic pump of claim 9, further comprising a flange surrounding a portion of the central aperture, wherein a radially inner surface of the flange is configured to be in contact with a radially outer surface of a rotor shaft of the motor of the cryogenic pump.

12. The cryogenic pump of claim 11, wherein the second inner channel is located between the flange and the serrated axial end surface.

13. A method of operating a cryogenic pump, the method comprising:

rotating a drive shaft of the cryogenic pump having a plurality of impellers fixedly coupled to the drive shaft with a rotor of a motor;

applying an axial force to the drive shaft; and sliding the drive shaft in an axial direction relative to the rotor of the motor while rotating the drive shaft with the rotor of the motor in response to the axial force, such that the drive shaft moves axially independently of the rotor.

14. The method of claim 13, further comprising moving a balance drum coupled to the drive shaft in an axial direction relative to the rotor.

15. The method of claim 14, further comprising compressing a fluid with the balance drum in response to axial movement of the balance drum.

16. The method of claim 15, further comprising slowing the axial movement of the balance drum and drive shaft with the fluid compressed by the balance drum.

17. The method of claim 13, further comprising sliding a bearing attached to the rotor in an axial direction relative to a housing of the cryogenic pump.

18. The method of claim 17, further comprising sliding the bearing within a bushing in an axial direction relative to the bushing.

19. The method of claim 18, further comprising applying an axial force to a set of two angular contact bearings with at least one of a balance drum or the rotor.

20. A method of customizing a balance drum for a cryogenic pump, the method comprising:

providing a balance drum having a serrated axial end surface;

determining a desired pressure difference across the balance drum during operation of the cryogenic pump;

removing a portion of the serrated axial end surface to provide a customized balance drum designed to achieve the desired pressure difference across the balance drum during operation of the cryogenic pump; and mounting the customized balance drum to a drive shaft such that the drive shaft with the customized balance drum coupled thereto is configured to move axially independently of a rotor of a motor that rotates the drive shaft with the customized balance drum coupled thereto.

* * * * *